United States Patent [19]

Isobe et al.

[11] Patent Number: 4,715,594

[45] Date of Patent: Dec. 29, 1987

[54] FACE AND BACK REVERSING MECHANISM

[75] Inventors: Minoru Isobe; Yoshinori Koshida; Katunori Yuasa, all of Tokyo, Japan

[73] Assignee: Oki Electric Industry Co., Ltd., Tokyo, Japan

[21] Appl. No.: 827,352

[22] Filed: Feb. 7, 1986

[30] Foreign Application Priority Data

Feb. 13, 1985 [JP] Japan ..... 60-26073

[51] Int. Cl.[4] ..... B65H 29/58

[52] U.S. Cl. ..... 271/65; 271/186; 271/187; 271/291; 271/902

[58] Field of Search ..... 271/65, 291, 186, 187, 271/902

[56] References Cited

U.S. PATENT DOCUMENTS 4,078,789 3/1978 Kittredge ..... 271/902 X
4,486,012 12/1984 Böck ..... 271/902 X
4,506,882 3/1985 Ito ..... 271/186 X

OTHER PUBLICATIONS

Xerox Disclosure Journal, vol. 2, No. 3, May/Jun. 1977, pp. 79, 80, "Paper Path for Automatic Duplex", Ari Bar-on.

*Primary Examiner*—Richard A. Schacher
*Attorney, Agent, or Firm*—Wenderoth, Lind & Ponack

[57] ABSTRACT

A face and back mechanism for coordinating the faces and backs of sheets has a rotating and moving device capable of holding sheets, a conveying passage feeding the sheets into the rotating and moving device, a stopper for stopping the sheets held by the rotating and moving device at a prescribed position, and an extracting and conveying-out device for extracting each of the stopped sheets from the rear end thereof and conveying it out. Any sheets to be reversed are reversed in a short period of time, and conveyed in the direction of a joint point of convergenge of the conveying passage and a bypassing passage.

8 Claims, 6 Drawing Figures

Fig. 3(III)
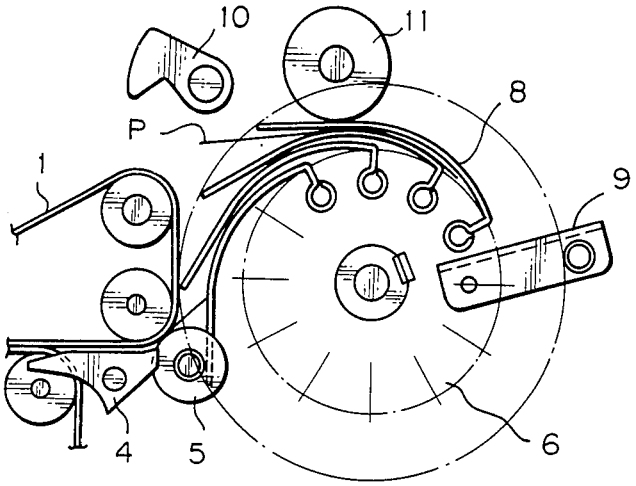

FACE AND BACK REVERSING MECHANISM

BACKGROUND OF THE INVENTION

1. Field of the Invention

The present invention relates to a mechanism for reversing the front face (hereinafter "face") and back face (hereinafter "back") of each of a plurality of sheets to permit the sheets to have the same faces or backs in the same direction for use in a device for treating the sheets such as, for example, bank notes.

2. Description of the Prior Art

A banking organ such as a bank profitably employs an apparatus for automatically treating bank notes for elimination or reduction of labor. For example, an automatic bank note depositing and dispensing machine is known to automatically deposit and dispense a bank note when operated by a customer.

A circulatory bank note depositing and dispensing machine begins to be put into practical use among machines of the type in recent years for effectively turning money and saving operators much time and labor to be expensed for replenishing and withdrawing bank notes, in which received bank notes by deposition are reusable for payment.

The circulatory bank note depositing and dispensing machine distinguishes bank notes decided to be genuine among deposited bank notes, into those to be reused and those to be rejected, and profitably employs the bank notes to be reused for payment.

A customer then receives bank notes put in order to be the same in the faces and backs thereof from the circulatory bank note depositing and dispensing machine to facilitate his confirmation of the amount of the bank notes.

However, bank notes deposited by a customer are not necessarily unified in the faces and backs thereof, but rather, are often irregular.

Thus, the circulatory bank note depositing and dispensing machine has a face and back reversing mechanism for unifying the faces and backs of bank notes deposited by a customer.

Such a face and back reversing mechanism is adapted up to now to convey bank notes having the faces and backs previously unified in the same direction to the next process through a bypassing passage as they are conveyed, while bank notes conveyed with in their faces and backs reversed are led to a face and back reversing passage by making use of a blade.

The face and back reversing passage forces the bank notes to U-turn on their way for reversing the faces and backs thereof, and thus to be conveyed in a reversed relation in the front and back ends thereof and to join the bypassing passage.

The arrangement for reversing the face and back of a bank note by making use of a U-turn thereof as described above can not accept the succeeding bank note until the preceding bank note passes through the U-turn passage after entering therein, and thus needs an interval between the preceding and succeeding bank notes by at least a bank note travelling distance corresponding to the passing time required by the bank note to get through the U-turn passage from the inlet end to the outlet end thereof. The interval causes a rate for treating the bank notes to be delayed.

Accordingly, provided that the face and back reversing passage has the U-turn passage, the bank note travelling distance and the time required for passage therethrough are substantially increased. This not only decreases the speed for treating a bank note arranged reversely with respect to the face and back thereof, but also that for treating the bank note arranged properly in the face and back thereof since the length of the bypass passage is specified depending on the bank note travelling distance and time. Thus, the overall face and back reversing mechanism is large-sized. Although the speed of conveying bank notes can be increased, it is considered that to raise the conveying speed is likely to cause the bank notes to be jammed.

In addition, the face and back reversing mechanism must have the U-turn passage, a guide means such as a blade for allowing any bank note to go in and out the U-turn passage, a drive means for switching the positions taken by the guide means when any bank note goes in and out the U-turn passage, and a conveying means for reversing the travelling direction of any bank note when it goes in and out the U-turn passage. These respective means must sufficiently follow up the travelling of bank notes also when the bank notes to be reversed are successively coming to the U-turn passage. However, they suffer from lack of fast response and stability.

Another face and back reversing mechanism is known other than the mechanism described above, wherein a part of the face and back reversing passage is rotatable by 180° independently of the other parts thereof, and that part is rotated by 180° to reverse the face and back of any bank note when it enters therein.

This modified face and bank reversing mechanism, however, requires a space for rotating the part of the reversing passage by 180°. Thus, it causes the whole of the bank note face and back reversing mechanism to be large-sized and thus requires a large scale rotary mechanism for rotating the reversing passage.

SUMMARY OF THE INVENTION

In view of the drawbacks with the conventional face and back reversing mechanism, it is an object of the present invention to provide a face and back reversing mechanism suitable for a fast treatment of a sheet such as a bank note.

Another object of the present invention is to provide a face and back reversing mechanism capable of securely operating at a high speed even when reversing in succession the faces and backs of bank notes.

Still another object of the present invention is to provide a compact face and back reversing mechanism.

According to the present invention, one end of a sheet previously decided to be the face or the back is guided by the rotating means and strikes on a stopper member at a position where the sheet is rotated by a prescribed angle while being held by the rotating means. The rotating means continues the operation thereof even if the sheet strikes on the stopper member to permit the sheet to go through the face and back reversing passage with ease. A sheet conveying-out means is provided on a position where the rear end of the sheet is positioned when the sheet strikes on the stopper member, for extracting the sheet from the rear end side thereof and feed it in the reversing passage. The sheet is reversed with respect to the face and back by being rotated and extracted as described above, and fed by means of the reversing passage to a joint portion with the bypassing passage through which another sheet passes.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Although a bank note will be exemplarily described here as a sheet most suitable for embodying a face and back reversing mechanism according to the present invention, any sheet may be applied thereto provided that it can be decided to be the face or the back by making use of proper optical, electromechanical, or magnetic means.

Figure 1:
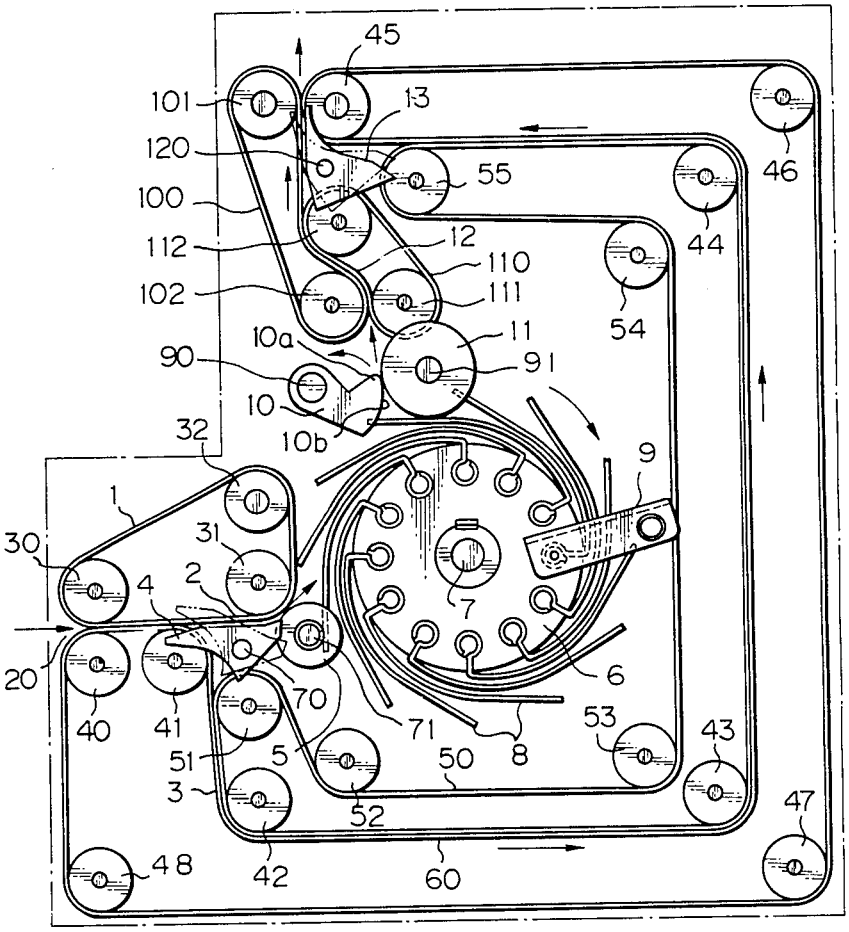
FIG. 1 is a schematical side view showing an embodiment of a face and back reversing mechanism according to the present invention.

As shown in FIG. 1 wherein arrangement of the face and back reversing mechanism is illustrated, an entrance part 20 of the present face and back reversing mechanism comprises two carrying conveying belts 1, 3 and pulleys 30, 40 around which the belts are trained. Bank notes are fed into the entrance 20 in the illustrated arrow direction from the face and back deciding means (not showing the drawings) located on the upstream side of the entrance part 20. The conveyor belt 1 is trained around the pulleys 30, 31, and 32, and holds bank notes with the conveyor belt 3 running between the pulley 40 and a pulley 41 to incorporate the bank notes into the face and back reversing mechanism. The conveyor belt 3 runs along a path guided by the pulleys 40 and 41, and pulleys 42 to 48. A conveyor belt 50 paired with the conveyor belt 3 runs along a path guided by a pulley 51, the pulleys 42 and 43, and 44, and pulleys 55, 54, 53, and 52. These two conveyor belts 3 and 50 form therebetween a second conveying passage 60, through which bank notes not requiring reversal with respect to the faces and backs thereof pass, bypassing a first conveying passage 2. On the other hand, the conveyor belt 1 forms the first conveying passage 2 leading bank notes to a face and back reversing passage together with a travel guiding surface of a blade 4 and an idle roller 5. The blade 4 disposed on the fork of the first and second conveying passages 2 and 60 is fixedly mounted on a shaft 70 which is rotated by a prescribed angle with the aid of a solenoid or a rotary magnet for thereby allowing the blade 4 to move between positions shown by illustrated solid and chain lines for leading bank notes to either of the first and second conveying passages 2 and 60.

The idle roller 5 located at an outlet of the first conveying passage 2 is rotatably attached to a shaft 71 and holds bank notes between it and the conveyor belt 1 guided by the pulley 31 to feed them to a pair of paddle wheels 6.

Figure 2:
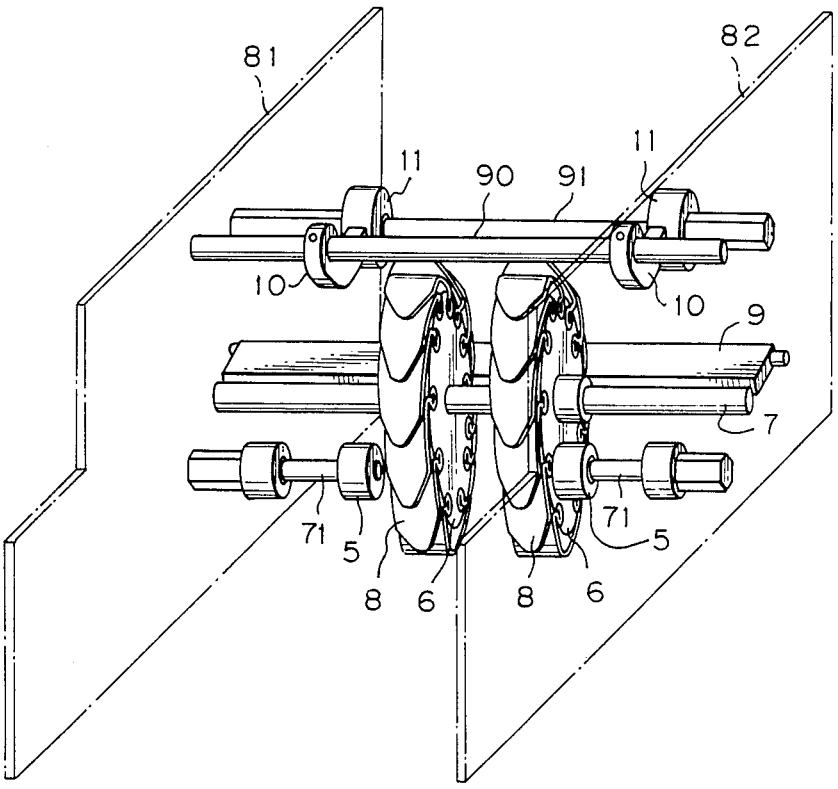
FIG. 2 is a schematical perspective view showing a portion of the mechanism of FIG. 1, and FIGS. 3(I) through 3(IV) are side views of portions of the embodiment of the face and back reversing mechanism according to the present invention, illustrating respective processes of the operation of reversing the face and back of any bank note.

Referring to FIG. 2 illustrating the paddle wheels 6 and a portion of a mechanism therearound, the paddle wheels 6 are respectively attached to the shaft 7 at right and left symmetrical positions thereon and respectively have twelve paddles 8 for inserting and holding bank notes, each spaced apart, at equal intervals on each outer periphery thereof. These paddles are arranged spirally and in an overlapping relation in the counterclockwise direction, and widely spaced away with each other in their radially outer ends and narrowly spaced in their base parts. The shaft 7 is rotatably supported on side frames 81, 82, to one end of which power is transmitted for rotating the paddle wheels 6 in the arrow direction of FIG. 1.

A pair of the right and left idle rollers 5 are located in front of the pair of the paddle wheels 6. Left and right shafts 71 having the respective left and right idle rollers 5 attached thereto extend from the right and left side frames 81, 82 toward the inside. The paddle wheels 6 are adapted to be rotatable without any obstruction in a wide space between the two idle rollers 5.

A plate-shaped stopper 9 is provided at a position where the paddle wheels 6 are further rotated by a half turn from their position facing the idle rollers 5. The stopper 9 has a slit-shaped gap through which the paddle wheels 6 and the paddles thereof pass as well as the upper flat surface for receiving an top ends of bank notes held between it and the paddles 8. A bank note kept on the paddle wheel 6 is conveyed to the stopper 9 with the rotation of the paddle wheel 6 and is stopped as its end makes close contact with the stopper 9 while corrected vertically in its inclination.

A pair of pickup arms 10 are attached to a shaft 90 rotatably supported on the side frames 80, 81 at right and left symmetrical positions of a shaft 90 and outside the paddle wheels 6, at which positions the rear end of a bank note stopped by the stopper 9 arrives. The pickup arms 10 are rotated counterclockwise, i.e., in the opposite direction of the rotation of the paddle wheels 6 by revolving power transmitted to one end of the shaft 90. The pickup arm 10 has an outer peripheral surface 10*b* on the free end side thereof, which surface partly forms the circumference of a circle formed around the shaft 90. The pickup arm 10 kicks up, in rotation thereof, the rear end of a bank note kept on the paddle wheel 6 and stopped by the stopper 9, and thereafter the outer periphery 10*b* of the pickup arm 10 is brought into contact with the idle roller 11.

The idle roller 11 is located facing to the pickup arm 10 and rotatably supported on a shaft 91 mounted on the side frames 81, 82. The idle roller 11 holds a bank note between it and the pickup roller 10 to draw it out of the paddle wheel 6 and feeds it to a third conveying passage 12.

The third conveying passage 12 serving to feed the bank note reversed in the face and back thereof to the next treating process located downstream the face and back reversing mechanism, comprises a conveyor belt 100 trained around pulleys 101, 102 and a conveyor belt 110 trained around pulleys 111, 112 and joins the second conveying passage 60 at the outlet thereof. A blade 13 provided at the fork of the second and third conveying passages 60 and 12 is fixedly mounted on a shaft 120, and moved between positions shown by the solid and chain lines of FIG. 1 by the prescribed angle of rotation of the shaft 120 to lead a bank note passing through either one of the second and third conveying passages 60 and 12 to the next treating process.

Operation of the arrangement described above will now be described.

A bank note whose face and back thereof has been sensed with the aid of the face and back deciding means is conveyed to the inlet of the face and back reversing mechanism. A bank note which has been sensed back by the deciding means has its back up at the inlet in the present embodiment.

The face and back reversing mechanism is ready for reversing the face and back of a bank note as revolving power is transmitted to the pulleys 37, 45, and 101, and the shafts 7 and 90. When the upward face of a bank note is decided to be the back, the blade 4 is moved to the position shown by the solid line before such bank note arrives here whereby the bank note is fed to the first conveying passage 2.

Figure 3I:
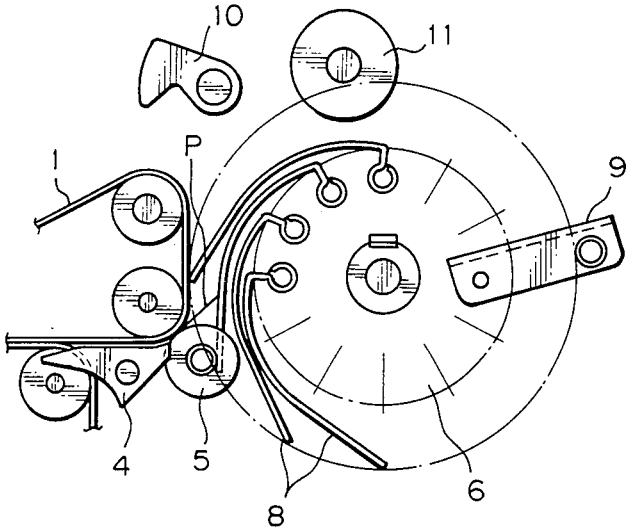

The behavior of the bank note after it is fed to the first conveying passage 2 will be described with reference to FIGS. 3(I) to (IV). A bank note P is held between the conveyor belt 1 and the idle roller 5 and fed obliquely upward toward the paddle wheel 6 which is in clockwise rotation at a lower speed than the feed speed of the bank note. Thus, the bank note P first strikes on the paddle 8 of the paddle wheel 6 in the top end thereof, and inserted between the paddles along them as shown in FIG. 3(II) as the bank note goes forward.

Although the paddle wheel 6 is rotated also while the bank note is inserted, the bank note P is satisfactorily insertable to the length enough to be held between the paddles 8 since the bank note is more rapidly inserted than the rotation of the paddle wheel 6. The paddle wheel 6 is rotated as shown in FIG. 3(III) while holding the bank note.

Figure 3:
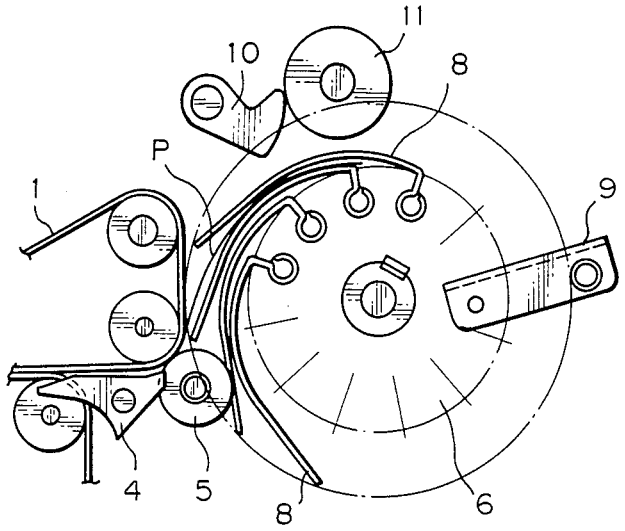
Figure 3:
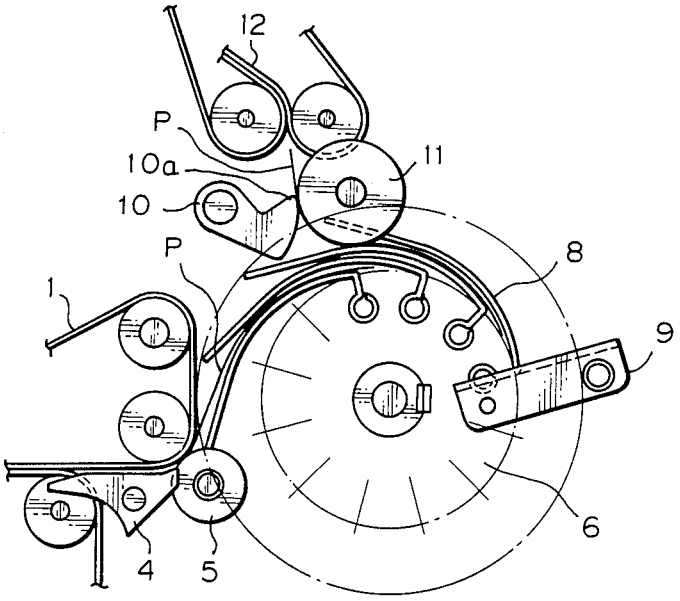

Assuming here that successive bank notes P sensed to have their backs facing up are conveyed in succession, the successive bank notes P are conveyed like the first bank note P as shown in FIG. 3(III) and inserted between the paddles 8 as shown in FIG. 3(IV).

The successive insertion of the bank notes P between the paddles 8 is effected alternately with respect to the paddles and controlled by setting the number of RPM of the paddles 8.

The rotation of the paddles 6 is set to 1/6th number of RPM of a separating and delivering means (not shown) for independently separating and delivering deposited bank notes P, such for example as a bank note separating and attracting drum (1/6 is selected because the bank notes P are insertable alternately among the total of twelve paddles 8; namely, six bank notes P can be inserted among the paddles 8 as the paddle wheel 6 is rotated by one revolution), and the paddle wheel 6 and the separating and delivering means are adapted to be rotated in synchronism with each other so as to permit the tip end of the bank note P to be insertable into prescribed portions of the paddles 8.

In addition, the purpose of the alternate insertion of the bank notes P among the paddles 8 is to prevent two bank notes from being taken out by the pickup arm 10 when a bank note P curled downward in its rear end is first inserted between any two of the paddles 8, and then two strong and straight bank notes are successively inserted between the adjoining two paddles 8.

By contrast, in using only bank notes P which are strong and straight, alternate insertion of the bank notes P among the paddles 8 is not needed, and they are insertable among all the pawls 8. Accordingly, the time interval needed to convey successive bank notes can be reduced whereby capability of the face and back reversing mechanism to treat the bank notes P can be improved.

The top end of the bank note P moved by the clockwise rotation of the paddle wheels 6 so construced is brought into contact with the stopper 9.

At this juncture, a bank note P slantingly inserted between any two of the paddles 6 is corrected perpendicularly to the bank note conveying passage.

While the bank note P is brought into contact with the stopper 9 as described above, with the pickup arms 10 turned counterclockwise, the tip end 10*a* of the pickup arm 10 scoops up the rear end of the bank note P which is then held between the pickup arm 10 and the idle roller 11 as shown in FIG. 3(IV).

The rotation of the pickup arm 10 is set so as to be rotated by one revolution with each one interval movement of the paddle 8 of the paddle wheel 6 which constitutes a ratchet wheel, and further set to be rotated in synchronism with the paddles 8 so as to permit the top end 10*a* thereof to make close contact with the idle roller 11 at a prescribed position with respect to the paddles 8.

Any bank note P is stopped by the stopper 9 while being pushed out between the paddles 8 by the rotation of the paddle wheel 6, extracted by the pickup arm 10 and the idle roller 11, and conveyed to the third conveying passage 12 for completion of reversing the bank note P. Namely, a portion of the bank note P, which was initially the rear end thereof, is turned to be the front end thereof and fed into the conveying passage, whereby the face and back thereof is reversed.

At this time, the blade 13 of the third conveying passage 12 is moved to the solid line position as shown in FIG. 1 to open the third conveying passage 12. Thus, the reversed bank note P is conveyed to the next process.

Moreover, the pickup arm 10 securely catches the rear end of the bank note P reversed and moved by the paddle wheel 6. Accordingly, the paddle wheel 6 may be rotated by one cycle of the conveyed bank note P. In the present embodiment, the pickup arm 10 is constructed to catch the rear end of the bank note P held and moved by the paddles 8 when the paddles 8 are rotated by the paddle wheel 6.

Accordingly, a travelling length of the bank note P needed to reverse it is minimized whereby the time required for its reversal is also shortened while the interval between successive bank notes P in conveyance can also be decreased and thus a space required therefor is also minimized to permit a fast treatment of bank notes as well as a compact face and back reversing mechanism.

Furthermore, the rotations of the paddles 8 and the pickup arm 10 are synchronized with the other mechanisms as described above. Consequently, no detection by a sensor, etc., is required for the insertion of the bank note P into the paddle wheel 6 that is a face and back reversing part, so that the time for electrical processing after detection by the sensor in mechanisms having such a sensor, etc., for detecting the insertion of the bank note into the face and back reversing part can be omitted, whereby the treating speed of bank notes P can be set faster.

On the other hand, when a bank note decided to be the face is conveyed to the face and back reversing mechanism, the blade 4 is turned upward as shown by a two-dot chain line of FIG. 1 to close the first conveying passage 2 and to open the second conveying passage 60.

As a result, the above bank note P is conveyed by the blade 4 to the second conveying passage 60 and further conveyed through the second conveying passage 60 bypassing the paddle wheel 6 while keeping the face of the bank note P up.

Then, the blade 13 is turned and shifted, as shown by the two-dot chain line of FIG. 1, to permit the second conveying passage 60 to join the third conveying passage 12.

Thus, the bank note conveyed to the second conveying passage 60 is conveyed by the blade 13 to the third conveying passage 12, and joins the above bank note reversed from the back to the face for their conveyance to the next process.

Hereupon, the length of the second conveying passage 60 is set to permit an inserted bank note whose back faces up to be reversed by the paddle 8, conveyed to the third conveying passage 12, and further conveyed to a position where unreversed bank notes conveyed along the second conveying passage 60 join the second conveying passage 12 in synchronism with the conveyance of such unreversed face up bank notes. In other words, the order of bank notes conveyed and the interval thereamong are kept constant.

Furthermore, although the paddle wheel 6 is set to be rotated in synchronism with the separating and delivering means for preventing bank notes from being jammed, it is possible, in reversing the back and face of a bank note likely to be folded, to securely treat the bank note without the synchronism.

Although a certain preferred embodiment has been shown and described, it should be understood that many changes and modifications may be made therein without departing from the scope of the appended claims.

What is claimed is:

1. A document front face and back face reversing mechanism, comprising:

moving means for continuously moving a succession of documents having front faces and back faces inserted at a entry position, forward end first, thereinto in succession, along a first conveyance path, all of the documents inserted into the moving means having a same one of the front face and the back face facing in a same direction at said entry position, said moving means including a plurality of continuously moving document holder parts for holding respective ones of the succession documents from said entry position to an extraction position;

stopper means at said extraction position, for successively receiving and stopping only the successive documents at said extraction position;

extracting and conveying means for successively extracting the successive documents from said holder parts, rearward ends first, and conveying the successive documents rearward ends first toward a merge position with the other one of the front faces and back faces of the successive documents facing in a given direction; and bypassing and conveying means for conveying other documents having the other of the front faces and back faces thereof facing in said same direction upstream of said entry position, along a second conveyance path bypassing said entry position and said moving means, to said merge position with the other one of the front faces and back faces thereof facing in said given direction.

2. A mechanism according to claim 1, wherein said moving means is a rotatable ratchet wheel having a plurality of paddles arranged at equal intervals around the outer periphery of said ratchet wheel for rotation therewith so as to hold the documents among said paddles while being rotated therewith.

3. A mechanism according to claim 1, wherein said stopper means has a flat surface for receiving the respective forward tip ends of the documents thereon and a slit for allowing said moving means to pass therethrough, and is located so as to receive the forward tip ends in the course of the movement of said moving means.

4. A mechanism according to claim 1, wherein said extracting and conveying means is provided upstream of said stopper means on said first conveyance path so as to be located in the vicinity of the rearward end of the document when stopped by said stopper means.

5. A mechanism according to claim 4, wherein said extracting and conveying means includes a roller supported rotatably and a pickup member provided pivotally at a position opposing said roller for striking on the rearward end of the document stopped by the stopper means, by the pivotal movement of said pickup member to guide the rearward end of the document in the direction of rotation of said roller while holding the rearward end of the document between said pickup member and said roller.

6. A mechanism according to claim 5, wherein said pickup member is rotated in synchronism with the movement of said moving means.

7. A document front face and back face reversing mechanism, comprising:

moving means for continuously moving a succession of documents having forward ends and rearward ends and having front faces and back faces, inserted into said moving means at a entry position, forward end first thereinto in succession, along a first conveyance path, all of the documents inserted into the moving means having a same one of the front face and the back face facing in a same direction at said entry position, said moving means including a plurality of continuously moving document holder parts for holding respective ones of the successive documents from said entry position to an extraction position;

a first passage means for conveying the succession of documents to said entry position and inserting the succession of documents one-by-one into said moving means at said entry position;

a second passage means for conveying other documents having the other of the front face and back face thereof facing in said same direction upstream of said entry position along a second conveyance path bypassing said entry position and said moving means;

a receiving and conveying means for receiving and conveying the succession of documents and the other documents one-by-one along an entry passage;

first guide means for guiding the succession of documents and the other documents one-by-one from said entry passage respectively to said first passage means and said second passage means;

stopper means at said extraction position, for successively receiving and stopping only the successive documents at said extraction position;

extracting and conveying means for successively extracting the successive documents from said holder parts, rearward ends first, and conveying the successive documents rearward ends first with the other one of the front faces and back faces of the successive documents facing in a given direction, along a third passage means to a merge position; said bypassing and conveying means including means for conveying the other documents along said second conveyance path bypassing said entry position and said moving means, to said merge position with the other one of the front faces and back faces thereof facing in said given direction; and second guide means, at said merge position, for guiding the documents conveyed by said second passage means and said third passage means, one-by-one onto a same downstream passage such that the succession of documents and the other documents are merged onto said same downstream passage for downstream movement therealong.

8. A mechanism according to claim 7, wherein said second passage means comprises a conveying passage extending from said first guide means to said merge position, having a process length corresponding to the time required for conveying the succession of documents from said first guide means to said merge position.

* * * * *